US012044101B2

(12) United States Patent
Xiao et al.

(10) Patent No.: US 12,044,101 B2
(45) Date of Patent: Jul. 23, 2024

(54) METHOD AND SYSTEM FOR POWER GENERATION AND USE

(71) Applicant: SAUDI ARABIAN OIL COMPANY, Dhahran (SA)

(72) Inventors: Jinjiang Xiao, Dhahran (SA); Songlin Zhong, Dhahran (SA); Chidirim Enoch Ejim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 7 days.

(21) Appl. No.: 18/046,781

(22) Filed: Oct. 14, 2022

(65) Prior Publication Data

US 2024/0125203 A1 Apr. 18, 2024

(51) Int. Cl.

| | |
|---|---|
| ***E21B 41/00*** | (2006.01) |
| ***E21B 34/06*** | (2006.01) |
| ***E21B 43/12*** | (2006.01) |

(52) U.S. Cl.

CPC ..... *E21B 34/066* (2013.01); *E21B 41/0085* (2013.01); *E21B 43/128* (2013.01)

(58) Field of Classification Search

CPC .... E21B 34/066; E21B 34/14; E21B 41/0085; E21B 43/35; E21B 43/128; E21B 33/12

See application file for complete search history.

(56) References Cited

U.S. PATENT DOCUMENTS 5,070,944 A 12/1991 Hopper
6,029,682 A * 2/2000 Lewis ..... F02M 63/004 251/129.02

(Continued)

FOREIGN PATENT DOCUMENTS

EP 2554786 A1 2/2013

OTHER PUBLICATIONS

"Specification for Subsurface Safety Valve Equipment", American Petroleum Institute; API Specification 14A; Twelfth Edition; Jan. 2015 (150 pages).

*Primary Examiner* — Taras P Bemko
(74) *Attorney, Agent, or Firm* — Osha Bergman Watanabe & Burton LLP

(57) ABSTRACT

A system includes an electric submersible pump (ESP) assembly configured to transport a fluid in a casing string of a well to a surface location. The ESP includes a pump configured to receive, upon activation, the fluid through a pump intake and vent the fluid through a pump discharge; an output shaft extending downhole from and fixed to the pump; and a control valve assembly. The control valve assembly includes a movable core of an electromagnet movable along a central axis of the system; a generator in electrical communication with the electromagnet, configured to generate electrical power to pull the movable core in an uphole direction upon activation of the pump of the electric submersible pump assembly; a shaft coupler coupling a generator input shaft and the output shaft; and a stinger having a conduit for the fluid to flow from the tubing string to the pump intake. The stinger includes at least one intake slot configured to receive the fluid; and an exit configured to vent the fluid to the pump intake of the electric submersible pump assembly. The control valve assembly also includes a flow tube connected to the movable core, the flow tube comprising an exterior surface creating fluid communication between the flow tube and the stinger before, when, or after the exterior surface uncovers the at least one intake slot of the stinger. The ESP also includes a spring configured to slide the movable core upon deactivation of the pump of the electric submersible pump assembly.

22 Claims, 5 Drawing Sheets

(56) References Cited

U.S. PATENT DOCUMENTS 6,113,675 A * 9/2000 Branstetter ..... B01D 19/0052 96/196
6,253,843 B1 7/2001 Rawson et al.
8,038,120 B2 10/2011 Vick et al.
8,267,167 B2 9/2012 Lake et al.
8,453,748 B2 6/2013 Vick et al.
8,464,799 B2 6/2013 Scott et al.
8,857,522 B2 10/2014 Arrazola et al.
8,919,730 B2 * 12/2014 Vick, Jr. ..... F16K 31/086 166/66.5
10,174,589 B2 1/2019 Vick et al.
10,670,160 B2 6/2020 Phelps
10,927,643 B2 2/2021 Ejim et al.
2004/0173362 A1 9/2004 Waithman et al.
2005/0092501 A1 * 5/2005 Chavers ..... E21B 34/10 166/386
2005/0095156 A1 * 5/2005 Wolters ..... E21B 34/101 417/555.1
2008/0135294 A1 * 6/2008 Pfahlert ..... B06B 1/045 74/25
2008/0302987 A1 * 12/2008 Corriveau ..... A01G 25/162 239/69
2010/0019182 A1 * 1/2010 Maercovich ..... F16K 31/3855 251/242
2012/0032964 A1 * 2/2012 Lippincott ..... G06F 9/5011 345/502
2012/0199367 A1 8/2012 Bouldin et al.
2013/0175042 A1 7/2013 Scott et al.
2014/0000870 A1 1/2014 Vick et al.
2014/0083712 A1 3/2014 Vick et al.
2017/0211352 A1 * 7/2017 Arraour ..... F04D 13/10
2018/0128083 A1 * 5/2018 Lastra ..... E21B 23/001
2018/0155991 A1 * 6/2018 Arsalan ..... E21B 23/06
2019/0162063 A1 * 5/2019 Brown ..... F04D 13/10
2019/0264518 A1 * 8/2019 Al-Gouhi ..... E21B 34/066
2020/0256159 A1 8/2020 Vick et al.
2021/0396097 A1 * 12/2021 Tiwari ..... E21B 37/00
2023/0279753 A1 * 9/2023 Artinian ..... E21B 31/00 166/301

* cited by examiner

METHOD AND SYSTEM FOR POWER GENERATION AND USE

BACKGROUND

The disclosure relates generally to production of fluid from subterranean reservoirs. More particularly, the disclosure relates to use of a subsurface safety valve (SSSV) in combination with a cable-deployed electric submersible pump (CDESP) for fluid production, and systems and methods for operating the SSSV.

In the oil and gas industry, hydrocarbons are located in reservoirs beneath the surface of the earth. Wells are drilled into these reservoirs to produce the hydrocarbons. The structure of a well is made of a plurality of casing strings cemented in place. A production string is set within the innermost casing string. The production string is used to provide a conduit for production fluids, such as hydrocarbons, to flow from the reservoir to a destination such as to the surface of the earth, to a bed of a body of water such as a lakebed or a seabed, or to a surface of a body of water such as a swamp, a lake, or an ocean (hereafter, surface.) Fluids produced from a hydrocarbon reservoir may include natural gas, oil, and water. The production string is made of production tubing and downhole production equipment. An SSSV is frequently installed as part of the production tubing to aid in well control.

An SSSV is a valve that is designed to shut off flow, through the production tubing, in a well control scenario. An SSSV may be deep-set or shallow-set. A deep-set SSSV is set downhole from the downhole production equipment. Thus, when a tool needs to be run into the production tubing to perform a workover on the downhole production equipment, an obstruction, such as wireline, does not need to pass through the deep-set SSSV. However, a deep-set SSSV leaves a significant volume of hydrocarbons between the deep-set SSSV and the surface thus creating more operational risk. A shallow-set SSSV is set much closer to the surface, above the downhole production equipment. However, the shallow-set SSSV must be designed in a way to shut off flow when an obstruction is run through the production tubing.

In some formations, pressure within the rock formation causes the resources to flow naturally from the formation to the surface. One common challenge in producing fluids from a hydrocarbon reservoir through a wellbore is that, in some formations, the pressure in the formation is not adequate to cause the flow against gravity out of the formation to the surface or is not adequate to cause the flow to meet flowrate goals. In such instances, artificial lift technology such as with an ESP can be used to add energy to fluid to bring the resources to the surface. Complications arise when an ESP or a CDESP is used in combination with a deep-set SSSV.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system comprising: an electric submersible pump (ESP) assembly configured to transport a fluid in a casing string of a well to a surface location. The ESP comprises a pump configured to receive, upon activation, the fluid through a pump intake and vent the fluid through a pump discharge; an output shaft extending downhole from and fixed to the pump; and a control valve assembly. The control valve assembly comprises a movable core of an electromagnet movable along a central axis of the system; a generator in electrical communication with the electromagnet, configured to generate electrical power to pull the movable core in an uphole direction upon activation of the pump of the electric submersible pump assembly; a shaft coupler coupling a generator input shaft and the output shaft; and a stinger having a conduit for the fluid to flow from the tubing string to the pump intake. The stinger comprises at least one intake slot configured to receive the fluid; and an exit configured to vent the fluid to the pump intake of the electric submersible pump assembly. The control valve assembly also comprises a flow tube connected to the movable core, the flow tube comprising an exterior surface creating fluid communication between the flow tube and the stinger before, when, or after the exterior surface uncovers the at least one intake slot of the stinger. The ESP also comprises a spring configured to slide the movable core upon deactivation of the pump of the electric submersible pump assembly.

In one aspect, embodiments disclosed herein relate to a method for generating electrical power within a well by converting rotational mechanical energy into electrical power using an electromagnetic power generator system, the method comprising: coupling, by a shaft coupler, a generator input shaft to an output shaft of a pump configured to transport a fluid; coupling, by a flow coupler, a flow tube of a control valve assembly to a movable core of an electromagnet; transferring, through the shaft coupler, rotational mechanical energy from the output shaft of the pump to the generator input shaft, thereby generating electromagnetic power; conducting, through at least one electrical conductor, the electromagnetic power to the electromagnet, thereby thrusting the movable core in an uphole direction along a central axis; uncovering at least one intake slot of a stinger before, when, or after an exterior surface of the flow tube moves in an uphole direction, thereby permitting fluid communication between the flow tube and the stinger; receiving the fluid through the at least one intake slot of the stinger; venting the fluid through an exit of the stinger to a pump intake of the pump; venting, by a pump discharge of the pump, the fluid to a surface location subsequent to receiving the fluid through the pump intake; and sliding, by a spring, the movable core upon deactivation of the pump, thereby moving the exterior surface of the flow tube to cover at least one intake slot of the stinger.

Other aspects and advantages of the claimed subject matter will be apparent from the following description and the appended claims.

DETAILED DESCRIPTION

Figure 1:
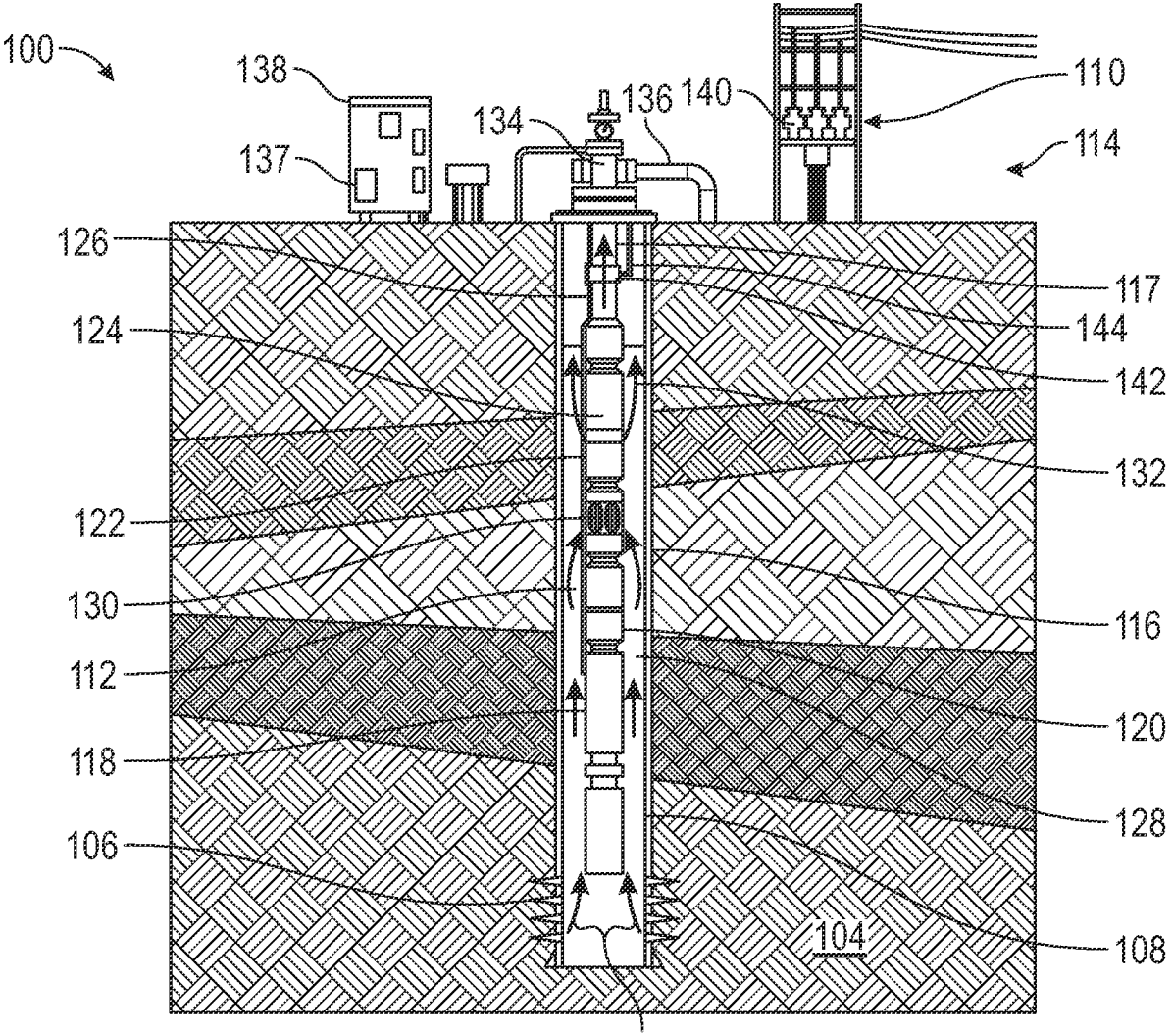
FIG. 1 shows an exemplary well with an Electrical Submersible Pump (ESP) completion design in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

For bringing liquids out of a subterranean wellbore to the surface of the earth, various techniques such as artificial lift technology may be used. Artificial lift technology may include, for example, a pump and associated components to assist in lifting the fluids up the wellbore. A pump may be deployed in the well using production tubing. As an example, production tubing associated with the wellbore may include one or more pumps installed in the tubing path to assist in lifting the fluids up the wellbore. The pump may be electrically operated and located submerged in the fluid at or near the bottom of the well. The pump system may use a surface or seabed power source to drive the submerged pump assembly. Alternatively, power for the pump may be provided at another location downhole in the well, such as a downhole fuel cell. These pump systems so configured are termed electric submersible pump (ESP) systems.

Notably, ESPs may be deployed by cable instead of tubing. Pumps deployed in this manner are known in the art as cable-deployed electric submersible pumps (CDESP.) The purpose is to be able to deploy and retrieve ESP systems more cost effectively without a workover rig. In some of these wells, subsurface safety valves (SSSV) are required by government regulations or operator procedures.

An SSSV is a normally closed valve designed to shut off flow in a well during an emergency to prevent the release of hydrocarbon. If a CDESP is utilized, it may pass through the SSSV, which means the cable of the CDESP remains in the production stream. In that case either the SSSV will not close because the cable in the way of its ball valve or flapper valve, or the SSSV needs to be capable of cutting the cable of the CDESP in the event of SSSV actuation.

One method to address the application of an SSSV in wells that have the cable in the production stream is the use of deep-set SSSV set below the Bottom-Hole Assembly (BHA). An alternative to the deep-set SSSV is a shallow-set SSSV. Novel solutions use the ESP to operate the SSSV without control lines from surface and without control panels. Drawbacks of these are described below.

This disclosure provides sand-tolerant methods and systems to operate safety valves with CDESP by using an electrical generator mounted below a CDESP. The power generated is used to operate an SSSV disposed below the CDESP. The electrical power operated SSSV uses a solenoid type actuator to move the flow tube to the open position and it uses magnetic coupling between the actuator and the flow tube.

FIG. 1 shows an exemplary ESP system (100). The ESP system (100) is used to help produce fluids (102) from a formation (104). Perforations (106) in the casing string (108) of the well (116) provide a conduit for the fluid (102) to enter the well (116) from the formation (104). The ESP system (100) includes surface equipment (110) and an ESP string (112). The ESP string (112) is deployed in a well (116) on production tubing (117) and the surface equipment (110) is located on a surface location (114). The surface location (114) is any location outside of the well (116), such as the surface of the earth. The production tubing (117) extends to the surface location (114) and is made of a plurality of tubulars connected to provide a conduit for formation fluids (102) to migrate to the surface location (114).

The ESP string (112) may include a motor (118), motor protectors (120), a gas separator (122), a multi-stage centrifugal pump (herein called a pump (124)), and an electrical cable (126). The ESP string (112) may also include various pipe segments of different lengths to connect the components of the ESP string (112). Motor (118) is a downhole submersible motor that provides power to the pump (124). Motor (118) may be a two-pole, three-phase, squirrel-cage induction electric motor. The motor operating voltages, currents, and horsepower ratings may change depending on the requirements of the operation.

The size of the motor (118) is dictated by the amount of power that the pump (124) requires to lift an estimated volume of fluid (102) from the bottom of the well (116) to the surface location (114). The motor (118) is cooled by the fluid (102) passing over the motor (118) housing. The motor (118) is powered by the electrical cable (126). The electrical cable (126) may also provide power to downhole pressure sensors or onboard electronics that may be used for communication. The electrical cable (126) is an electrically conductive cable that is capable of transferring information. The electrical cable (126) transfers energy from the surface equipment (110) to the motor (118). The electrical cable (126) may be a three-phase electric cable that is specially designed for downhole environments. The electrical cable (126) may be clamped to the ESP string (112) in order to limit electrical cable (126) movement in the well (116). In further embodiments, the ESP string (112) may have a hydraulic line that is a conduit for hydraulic fluid. The hydraulic line may act as a sensor to measure downhole parameters such as discharge pressure from the outlet of the pump (124).

Motor protectors (120) may be located above (i.e., uphole from, or closer to the surface location (114) than) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from the fluid (102). The seals further equalize the pressure in an annulus (128) with the pressure in the motor (118). Annulus (128) is the space in the well (116) between the casing string (108) and the ESP string (112). A pump intake (130) is the section of the ESP string (112) where the fluid (102) enters the ESP string (112) from the annulus (128).

Pump intake (130) is located above the motor protectors (120) and below the pump (124). The depth of the pump intake (130) is designed based off the formation (104) pressure, estimated height of the fluid (102) in the annulus (128), and optimization of pump (124) performance. If the fluid (102) has associated gas, then gas separator (122) may be installed in the ESP string (112) above the pump intake (130) but below the pump (124). The gas separator (122) removes the gas from the fluid (102) and injects the gas (depicted as separated gas (132)) into annulus (128).

The pump (124) is located above the gas separator (122) and lifts the fluid (102) to the surface location (114). The pump (124) has a plurality of stages that are stacked upon one another. Each stage contains a rotating impeller and stationary diffuser. As the fluid (102) enters each stage, the fluid (102) passes through the rotating impeller to be centrifuged radially outward gaining energy in the form of velocity. The fluids (102) enter the diffuser, and the velocity is converted into pressure. As the fluid (102) passes through each stage, the pressure continually increases until the fluid (102) obtains the designated discharge pressure and has sufficient energy to flow to the surface location (114). The ESP string (112) outlined in FIG. 1 may be described as a standard ESP string (112), however, the term ESP string (112) may refer to a standard or typical tubing-deployed ESP string (112) or an inverted ESP string (112) without departing from the scope of this disclosure. An inverted ESP positions the motor above the pump.

In other embodiments, sensors may be installed in various locations along the ESP string (112) to gather downhole data such as pump intake (130) pressures, discharge pressures, and temperatures. The number of stages is determined prior to installation based on the estimated required discharge pressure. Over time, the formation (104) pressure may decrease and the height of the fluid (102) in the annulus (128) may decrease. In these cases, the ESP string (112) may be removed and resized. Once the fluid (102) reaches the surface location (114), the fluid (102) flows through the wellhead (134) into production equipment (136). The production equipment (136) may be any equipment that can gather or transport the fluids (102) such as a pipeline or a tank.

The ESP system (100) may include an SSSV (142) installed on production tubing (117). SSSV (142) may be installed near the surface location (114). SSSV (142) is a valve, such as a flapper valve, which may be used to block fluid (102) from flowing up the ESP string (112) and to the surface location (114). SSSV (142) may be used as part of the shut-in system of the well (116). In scenarios where the well (116) needs to be shut in, such as for repairs or in an emergency, SSSV (142) along with other valves located in the wellhead (134) are closed. SSSV (142) may be controlled using an SSSV control line (144). The SSSV control line (144) may connect the SSSV (142) to a control module at the surface location (114). The SSSV control line (144) may be a conduit for hydraulic fluid. The control module may use the hydraulic fluid within the SSSV control line (144) to open or close the SSSV (142).

The remainder of the ESP system (100) includes various surface equipment (110) such as electric drives (137), pump control equipment (138), the control module, and an electric power supply (140). The electric power supply (140) provides energy to the motor (118) through the electrical cable (126). The electric power supply (140) may be a commercial power distribution system or a portable power source such as a generator. The pump control equipment (138) is made up of an assortment of intelligent unit-programmable controllers and drives that maintain the proper flow of electricity to the motor (118) such as fixed-frequency switchboards, soft-start controllers, and variable speed controllers. The electric drives (137) may be variable speed drives that read the downhole data, recorded by the sensors, and may scale back or ramp up the motor speed to optimize the pump (124) efficiency and production rate. The electric drives (137) allow the pump (124) to operate continuously and intermittently or to be shut-off in the event of an operational problem.

Cable-deployed electric submersible pump (CDESP) systems, as one skilled in the art will be aware, are rigless ESP systems (100) that are designed to bring wells (116) on production faster and lower the costs associated with installing and replacing ESP systems (100). CDESP systems feature an inverted ESP system (100) configured with the motor (118) connected directly to electrical cable (126), which improves the overall reliability of the system.

In CDESP systems, setting SSSV (142) below the bottom-hole assembly may be employed. Setting SSSV (142) below the bottom-hole assembly is known in the art as a deep-set SSSV. Drawbacks of the deep-set SSSV may include the requirement of long control lines (144) and the need to replace surface control panels already in place when converting wells (116) from a typical tubing deployed ESP system (100) to a CDESP system. SSSV (142) may be electrically operated and the source of the electrical power may derive from electrically-tapping off the electrical power supplied to motor (118). Operating SSSV (142) electrically provides the advantage of elimination of the long control lines (144), but introduces several other disadvantages. Electrically-operating SSSV (142) by using power tapped off of motor (118) may introduce reliability issues such as one or more additional electrical connections and power regulating electronic devices. Electrically-operating SSSV (142) in a CDESP deep-set configuration by using power tapped off of electrical cable (126) may introduce reliability issues such as requiring the electrical conductor from electrical cable (126) to be run alongside the exterior of pump (124) and other components of system (150) thus increasing the possibility for damage to the electrical conductor when deploying ESP string (112).

An alternative to the deep-set SSSV is a shallow-set SSSV. The SSSV (142) installed near the surface location (114) may have relatively short control lines (144). The application of a shallow-set SSSV is complicated by the electrical cable (126) of the CDESP in the production stream. The power cable of the CDESP running through the center of the SSSV interferes with operation of the SSSV. The SSSV must seal against the flow of fluid (102) to the surface location (114) but cannot because of the cable preventing the SSSV closing. In addition, the use of a shallow-set SSSV complicates the deployment and retrieval of the CDESP system, especially under live well (116)

conditions. Novel solutions use a CDESP system to operate the SSSV (142) without control lines (144) from the surface location (114). These designs suffer from sand production and accumulation issues. Flow tubes and springs of these designs may become jammed by sand disposed within the fluid (102), preventing proper functionality of SSSV (142). Embodiments disclosed herein present systems (150) and methods of operating SSSV (142).

Figure 2:
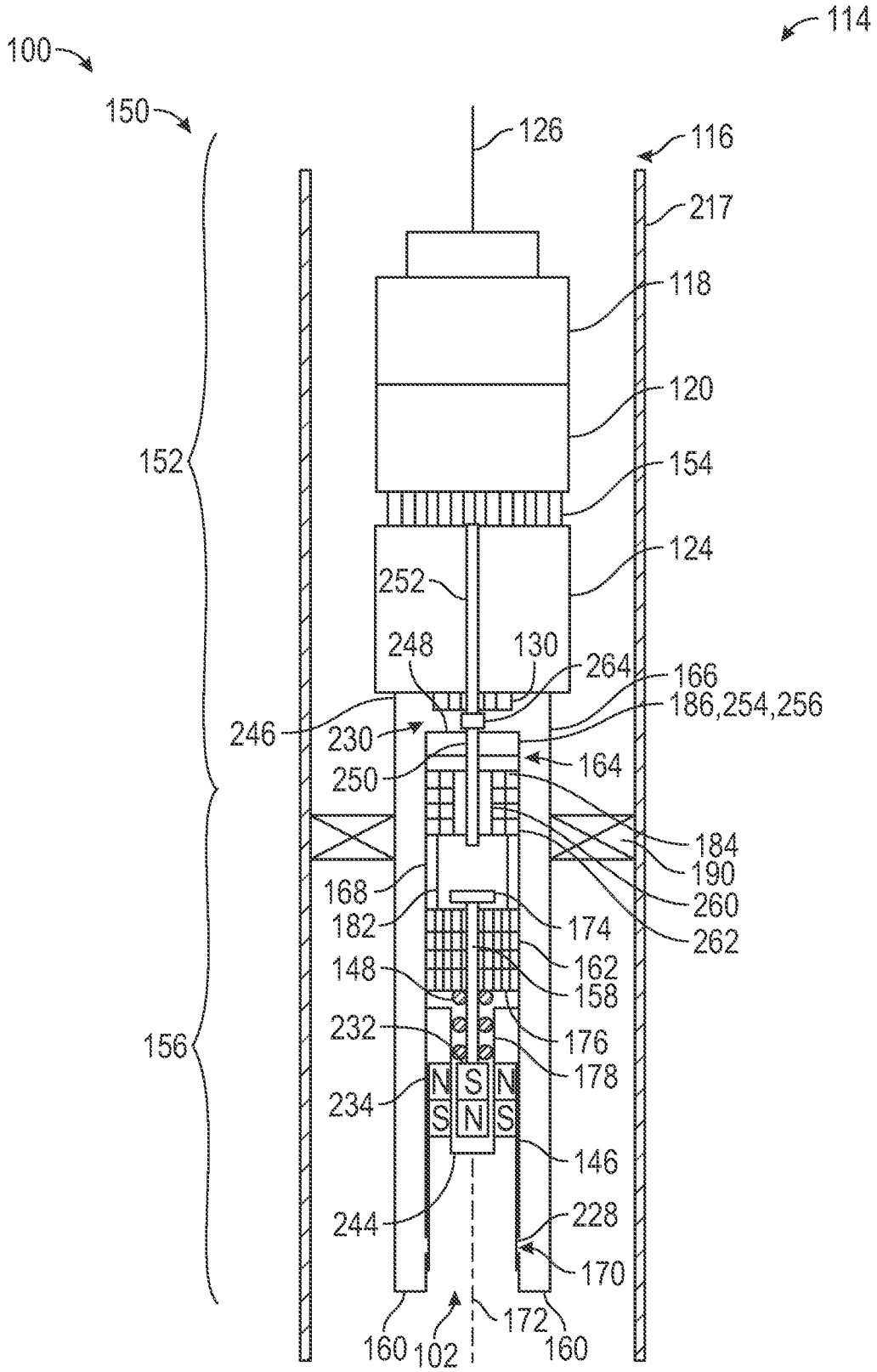
FIG. 2 shows a cross-sectional view of a system in accordance with one or more embodiments of the present disclosure.

FIG. 2 shows a cross-sectional view of the system (150) in accordance with one or more embodiments of the present disclosure. The system (150) includes an ESP (152) and a flow regulating valve (156). Flow regulating valve (156) of the systems (150) and methods comprises a flow tube (146), a movable core, hereafter, core (158), a stinger (160), a spring (148), and an electromagnet (162). ESP (152) of the systems (150) and methods comprises a pump (124), pump intake (130), and a pump discharge (154). The system (150) prevents sand accumulation, thereby ensuring proper functionality. In this embodiment, the ESP (152) is a CDESP system and includes a motor (118) connected directly to electrical cable (126). When activated, the pump (124) of the ESP (152) receives a fluid (102) disposed in the production tubing (217) of the well (116) through the pump intake (130) and vents the fluid (102) through the pump discharge (154) to the surface location (114).

The flow regulating valve (156) includes a stinger (160), a flow tube (146), a solenoid type actuator using electromagnet (162) with core (158), and a spring (148). Core (158) is located coaxially with the electromagnet. Core (158) is made of a magnetic material such as a permanent magnet or a ferromagnetic material. Electromagnet (162) may be formed in a cylindrical shape with an axis and with a central bore along the axis and along which the core (158) is disposed. Electrical conductors such as copper wires may be wound in a coil pattern around the annular area between outer and inner surfaces of electromagnet (162). Core (158) is movable by cooperating with electromagnet (162) to move in an axial direction upon application of an electrical current applied to electromagnet (162).

An upper open end (e.g., an exit (230)) of the stinger (160) of the flow regulating valve (156) may be connected to the ESP (152) by attaching the upper surface of the stinger (160) to the pump (124). When joined together, the flow regulating valve (156) is disposed downhole of the ESP (152). The stinger (160) includes a conduit (164) for the fluid (102) to flow from the production tubing (217) of the well (116 FIG. 1) to the pump intake (130). Further, the stinger (160) is tubularly shaped and includes an annular outer wall (166) defined by an outer diameter and an annular inner wall (168) defined by an inner diameter. Additionally, the stinger (160) may include upper and lower surfaces connecting the outer wall (166) and inner wall (168). The conduit (164) of the stinger (160) is disposed between the outer wall (166) and the inner wall (168). In general, the stinger (160) is made of a robust material such as steel and may further include at least one intake slot (170). The intake slots (170) are located on the inner wall (168) at a downhole end of the stinger (160). The downhole end of the stinger (160) is an end of the stinger (160) including the lower surface. The intake slots (170) are openings of the stinger (160) which permit the fluid (102) from the production tubing (217) of the well (116 FIG. 1) to enter the conduit (164) of the stinger (160). Fluid within the conduit (164) exits the conduit at the upper open end (e.g., the exit (230)) of the conduit. In this way hydraulic communication is established.

The flow tube (146) of the flow regulating valve (156) is disposed within an interior of the stinger (160) defined by the space inside the inner wall (168) of the stinger (160). The flow tube (146) may be tubularly shaped and may be formed of a durable material, such as a hard polymer or steel. In addition, the flow tube (146) is movable within the interior of the stinger (160) along a central axis (172) of the system (150). In other embodiments, flow tube (146) may be movable along an axis offset from the central axis (172). Hydraulic communication between the conduit (164) and the flow tube (146) is established before, when, or after the flow tube (146) is moved into a position such that an exterior surface (228) of flow tube (146) no longer covers intake slots (170) of stinger (160). The hydraulic communication is established before, when, or after exterior surface (228) of flow tube (146) moves out of the way of intake slots (170) due to the fact that the flow will begin as soon as a path is created, even though the valve is not yet fully open. However, when the flow tube (146) is moved into a position such that the exterior surface (228) of flow tube (146) covers the intake slots (170) of the stinger (160), then hydraulic communication between the conduit (164) and flow tube (146) is lost and fluid (102) from the production tubing (217) of the well (116) is unable to enter conduit (164).

Core (158) of the flow regulating valve (156) is also disposed within the interior of the stinger (160), above the flow tube (146). In the embodiment depicted in FIG. 2, core (158) comprises a rod rigidly fixed to a disk (174). The rod and disk (174) may both be formed of a similar, durable material such as steel. Disk (174) is disposed at the upper end of the core (158) and may have a diameter less than the diameter of the interior of the stinger (160). The rod is disposed downhole of disk (174). The downhole end of the rod is fixed to a driving magnetic coupler, hereafter, driver (232). The uphole end of the flow tube (146) is fixed to a driven magnetic coupler, hereafter, driven coupler (234). In this way, the flow tube (146) is magnetically coupled to the downhole end of the core (158). Accordingly, the core (158) is designed to move the flow tube (146) within the flow regulating valve (156) upon application of an electrical current to electromagnet (162).

Before, when, or after deactivation of ESP system (100) pump (124) is inactive and core (158) is positioned within the flow regulating valve (156) by a spring (148). The spring (148) is configured to move core (158) along the central axis (172) of the system (150). In this particular embodiment, the spring (148) is a compression spring and may be formed of a robust spring steel such as high-carbon, alloy, or stainless steel. The spring may be formed of a non-metallic material such as carbon-fiber or glass reinforced plastic, fiberglass, or other material. Spring (148) may act upon the uphole end of the driver (232), thereby moving the rod of core (158) within the flow regulating valve (156) in a downhole direction. In addition, the rod of core (158) may be disposed through the central opening of spring (148). Spring (148) is supported by and fixed to a spring support (176), which may be the downhole surface of electromagnet (162), disposed within the interior of the stinger (160). The spring support (176) limits the uphole movement of core (158). Further, the spring support (176) may be a steel disk fixed to the inner wall (168) of the stinger (160) within the interior of the stinger (160) and includes an opening in its center that the rod of core (158) may pass through.

In one or more embodiments, a housing (178) prevents sand ingress to the interior of housing (178) and thus prevents sand and other contaminants from interfering with the operation of the components disposed within housing (178). Housing (178) may house a generator (184), at least one conductor (182), electromagnet (162), core (158), spring (148), and driver (232) and may be filled with a barrier fluid such as a motor oil to provide lubrication and pressure compensation to the components disposed in housing (178). Electromagnet (162) may be disposed within housing (178) downhole from disk (174) of core (158), within inner wall (168) of the stinger (160), and uphole from driver (232). Housing (178) may be cylindrical in shape. In the embodiment depicted in FIG. 2, the housing (178) is disposed within the interior of the stinger (160) between the pump intake (130) and driven coupler (234). A lower boundary (244) of housing (178) is downhole from the downhole end of driver (232). Housing (178) includes a housing wall (246) configured in a shape such as a tubular shape to allow cooperation between driver (232) and driven coupler (234) of flow tube (146). An upper boundary (248) of housing (178) includes an opening configured to accommodate an input shaft (250) of generator (184). Input shaft (250) of generator (184) may cooperate with an output shaft (252) of pump (124). Housing (178) may be configured to accommodate a pressure differential. Upper boundary (248) may include a pressure compensator (254) and a shaft seal (256) connected to housing wall (246). Pressure compensator (254) may be configured to compensate for a pressure differential between housing interior and housing exterior. Shaft seal (256) may be configured to prevent pressure leakage or pressure communication between the housing interior and housing exterior and to permit rotation of input shaft (250). Together the pressure compensator (254) and shaft seal (256) comprise a seal section (186) of generator (184). Seal section (186) is designed for pressure compensation and to provide a barrier between housing (178) and conduit (164). Seal section (186) may comprise a mechanical shaft seal for input shaft (250) of generator (184) to prevent fluid (102) of well (116) from invading housing (178) in which generator (184) is enclosed. Seal section (186) may comprise elastomer bags, bellows, labyrinth, etc., and may be in hydraulic communication with housing (178) to allow expansion and contraction of the barrier fluid. Seal section (186) may comprise a small-scale version of commercial seal sections for ESP motors, well known in the art. Seal section (186) may include a thrust handling capability. Seal section (186) may include a bearing such as a radial bearing to provide stability to the rotating shaft against runout, wobble, oscillations, divergence, spatial deformation, etc.

Generator (184) is disposed within housing (178) at the uphole end of housing (178) and below pump intake (130). Conductors (182) may be disposed within housing (178). Conductors (182) transmit electrical power from generator (184) to electromagnet (162). Input shaft (250) of generator (184) transfers rotational mechanical energy into a rotor (260) of generator (184). Rotor (260) may comprise one or more wire coils, permanent magnets, or both. Rotor (260) is disposed within stator (262) of generator (184). Stator (262) may comprise one or more wire coils, permanent magnets, or both. Rotor (260) and stator (262) cooperate to generate electrical power when rotor (260) receives rotational mechanical energy.

In one or more embodiments, rotational mechanical energy is provided between output shaft (252) of pump (124) and generator (184) by a shaft coupler (264), such as a spline coupling, jaw coupling, sleeve coupling, shaft adapter, bellows coupling, etc. In this way output shaft (252) of pump (124) transfers rotational mechanical energy of ESP (152) to input shaft (250) of generator (184). Although FIG. 2 shows shaft coupler (264) external to housing (178) uphole from seal section (186), this relative position is not intended to be limiting. Any suitable position of shaft coupler (264) external or internal to housing (178), or both internal and external to housing (178) and providing similar functionality to that described may also be implemented without departing from the scope of the present disclosure. Rotational mechanical energy transferred to input shaft (250) is converted by generator (184) to electrical power. The electrical power is transferred through conductors (182) to electromagnet (162). Electromagnet (162) applies a force to core (158), thereby pulling core (158) uphole. Driver (232) inside housing (178) cooperates with driven coupler (234) outside of housing (178). Driven coupler (234) is attached to flow tube (146). Accordingly, flow tube (146) moves uphole as the core (158) moves uphole, and spring (148) is compressed.

Furthermore, the system (150) may include a packer (190). Packer (190) is set inside the production tubing (217). System (150) is deployed into well (116) using power cable (126) and stings (or stabs) into packer (190). Packer (190) creates a fluid-tight seal between the outer wall (166) of the stinger (160) and the production tubing (217) in order to provide isolation between the fluid (102) entering the pump intake (130) of the ESP (152) and the fluid (102) exiting the pump discharge (154). In this way, the packer (190) prevents fluid recirculation within the system (150). FIG. 2 shows packer (190) above electromagnet (162) and flow regulating valve (156). This relative position is not intended to be limiting. Any suitable position of packer (190) with respect to electromagnet (162) and flow regulating valve (156) providing similar functionality to that described may also be implemented without departing from the scope of the present disclosure.

Figure 3A:
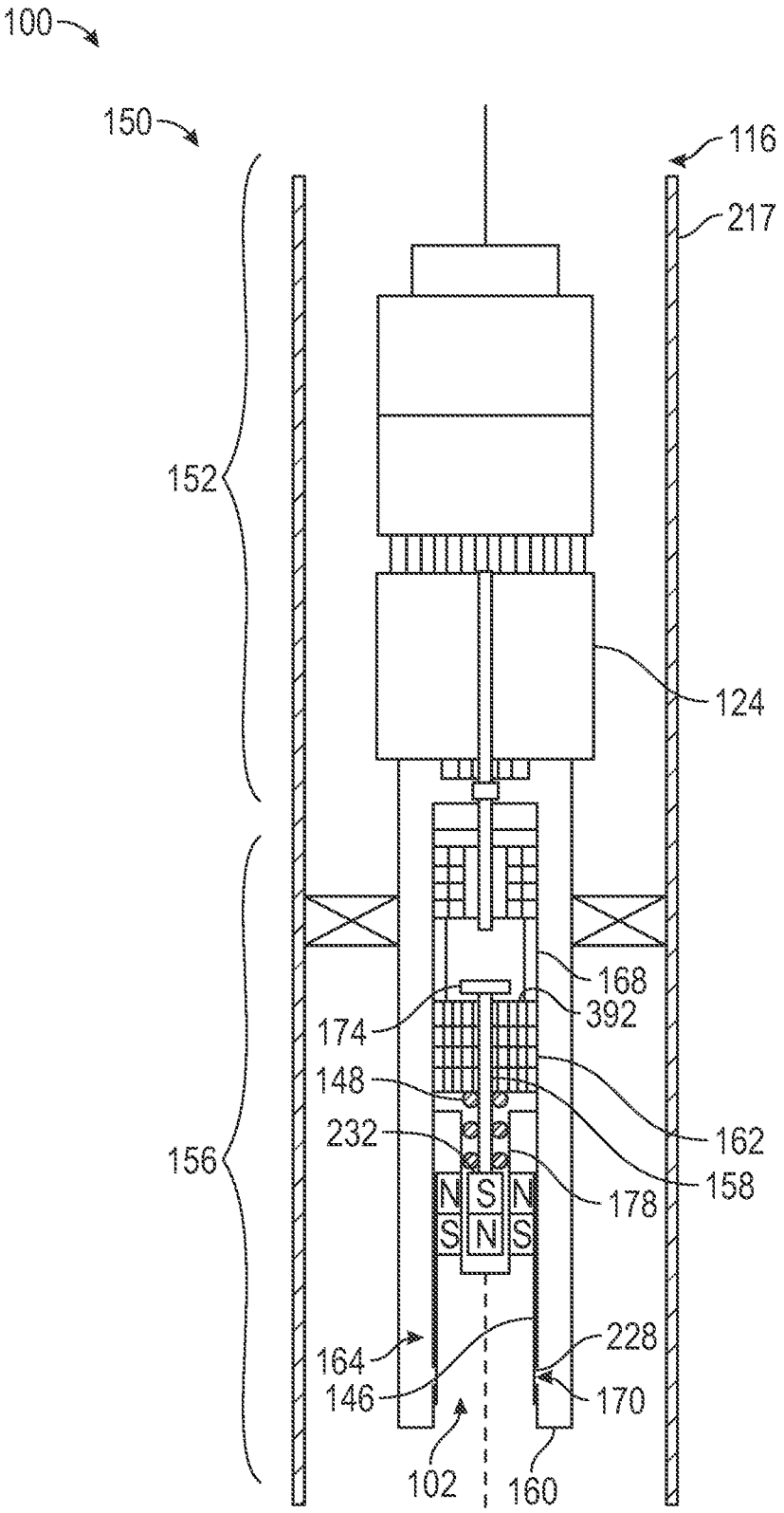
FIGS. 3A and 3B show diagrams depicting the operational sequence of the system in accordance with one or more embodiments.
Figure 3B:
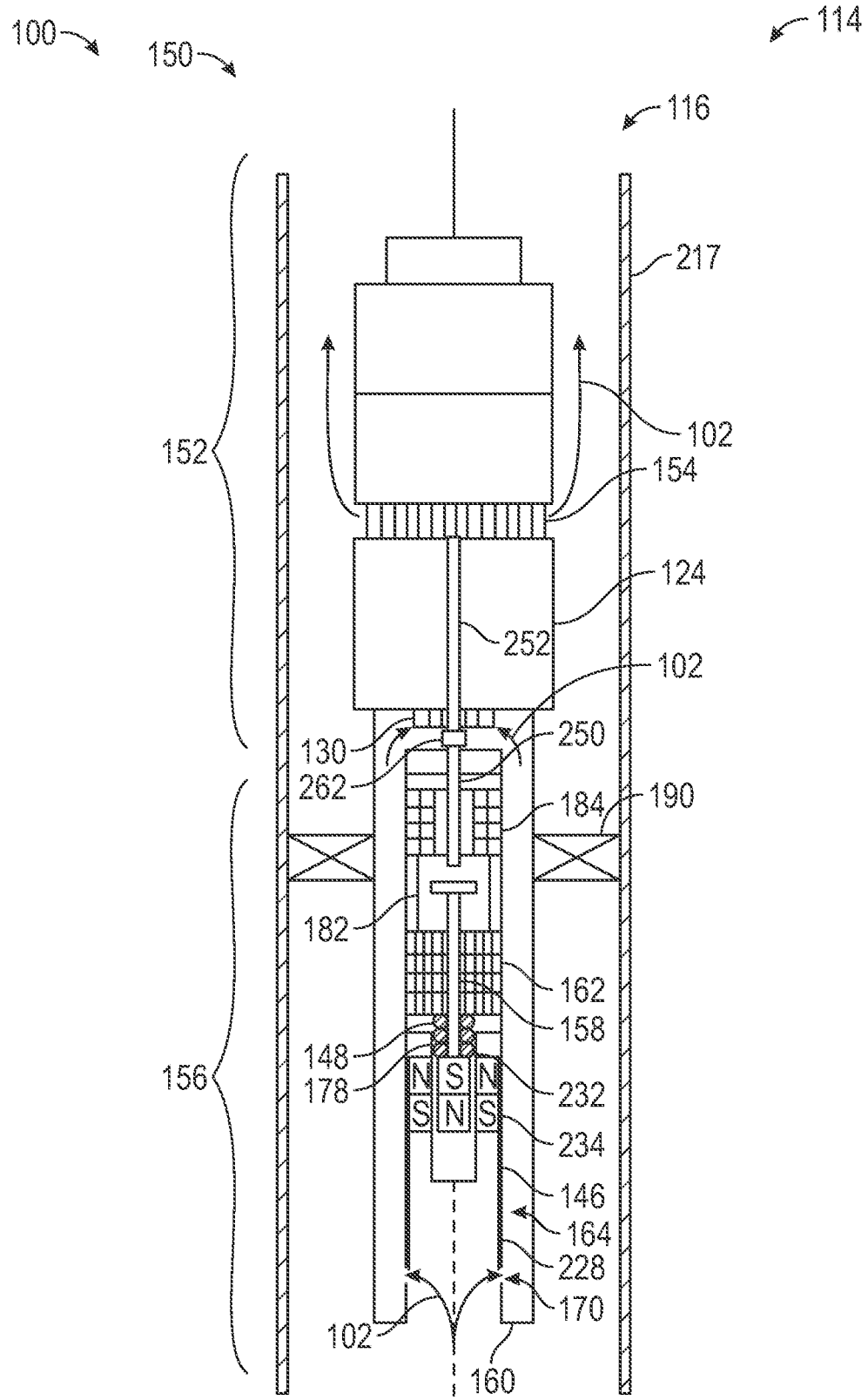

FIGS. 3A and 3B show diagrams depicting the operational sequence of the system (150) in accordance with one or more embodiments. In particular, FIG. 3A shows the system (150) ESP system (100) during deactivation with the pump (124) of the ESP (152) inactive. Here, the spring (148) of the flow regulating valve (156) is expanded and applies a force in a downhole direction upon the driver (232) attached to the rod of core (158). Consequently, disk (174) of core (158) contacts a stopper (392) and stopper (392) limits the downhole movement of the core (158). Stopper (392) may be the uphole surface of electromagnet (162) or other structure such as a metal ring, pin, or bracket fixed to the inner wall (168) of the stinger (160), protruding from the inner wall (168) towards the interior of the stinger (160). The stopper (392) may be formed of a durable material such as steel.

In addition, in the condition where disk (174) of core (158) rests against stopper (392), exterior surface (228) of flow tube (146) blocks intake slots (170) of stinger (160). In the embodiment shown, flow tube (146) is located below intake slots (170) of stinger (160). Therefore, the exterior of the downhole end of flow tube (146) covers intake slots (170) of stinger (160), thereby preventing fluid (102) disposed in production tubing (217) of well (116) from entering conduit (164) of stinger (160).

FIG. 3B shows system (150) when pump (124) of ESP (152) is active. When pump (124) is activated, output shaft (252) of pump (124) supplies rotational mechanical energy through shaft coupler (264) to input shaft (250) of generator (184) to generate electrical power. Electrical power is transferred through conductors (182) to electromagnet (162). Electromagnet (162) moves core (158) uphole within flow regulating valve (156). Core (158) moves uphole before, when, or after an electromagnetic force exerted on core (158) in an uphole direction is greater than a spring force of spring (148) exerting force in a downhole direction on driver (232). Before, when, or after electromagnetic force causes core (158) to compress the spring (148), then the core (158), driver (232), driven coupler (234) and, thus, flow tube (146) are positioned within flow regulating valve (156) such that the exterior surface (228) of flow tube (146) does not cover intake slots (170) of stinger (160).

With the intake slots (170) of the stinger (160) uncovered by the flow tube (146), hydraulic communication between the conduit (164) of the stinger (160) and an interior of flow tube (146) is established. In this way, pump intake (130) and production tubing (217) of well (116) are also in hydraulic communication. Therefore, a suction force produced by pump (124) of ESP (152) causes fluid (102) from within production tubing (217) to enter flow tube (146), pass through intake slots (170), travel upwards within conduit (164), and enter pump intake (130). From pump intake (130), fluid (102) flows upwards through pump (124) to pump discharge (154). Pump discharge (154) then vents fluid (102) into production tubing (217) above packer (190). In turn, fluid (102) travels upwards in production tubing (217) to surface location (114) to be produced.

Although embodiments disclosed here describe use of a magnetic coupler to couple the core (158) to flow tube (146), this is not intended to be limiting. Any suitable coupler providing similar functionality to that described may also be implemented without departing from the scope of the present disclosure. For example, the core may include a thread that engages a mating thread on the flow tube. Examples of means of coupling may include fasteners such as studs, nuts, screws, bolts, and pins engaging flow tube (146), e.g., through a hole or slot in the flow tube. The coupling may further use a dovetail slot on one or both of the flow tube or the core and a mating dovetail rail on the other of the flow tube or the core. The coupling may include one or more sliding bearings such as a ball bearing, cylindrical roller bearing, spherical roller bearing, tapered roller bearing, and/or journal bearing on one or both of the flow tube or the core and a mating sliding surface.

Although embodiments disclosed here describe use of a linear solenoid type actuator, this is not intended to be limiting. Any suitable actuator providing similar functionality to that described may also be implemented without departing from the scope of the present disclosure. For example, generated electric power can also be used to move flow tube (146) via an electric motor providing lifting force by turning a jack screw, powering a hydraulic pump providing hydraulic fluid to a hydraulic cylinder, driving a gear on a gear rack, rotating a lever, etc. Those skilled in the art will readily appreciate that the means for coupling and the means for moving the flow tube combining fasteners, bearings, and actuators may be configured without departing from the scope of this disclosure.

Although embodiments disclosed here describe use of a shaft coupler (264), this is not intended to be limiting. Output shaft (252) and input shaft (250) may be one in the same. Furthermore, any suitable coupler providing similar functionality to that described may also be implemented without departing from the scope of the present disclosure. For example, a magnetic shaft/rotational coupler may replace shaft coupler (264). Use of a magnetic rotational coupler, such as a co-axial shaft magnetic coupling, along with a containment barrier between inner and outer hubs of the co-axial coupling, may avoid having the generator shaft penetrate out through housing (178) and may eliminate necessity of seal section (186), or the pressure compensator (254), shaft seal (256), or both. A co-axial shaft magnetic coupling barrier may form part of housing (178). The magnetic rotational coupler may offer advantages of better pressure/fluid isolation for example for the housing (178) and for pump (124).

Figure 4:
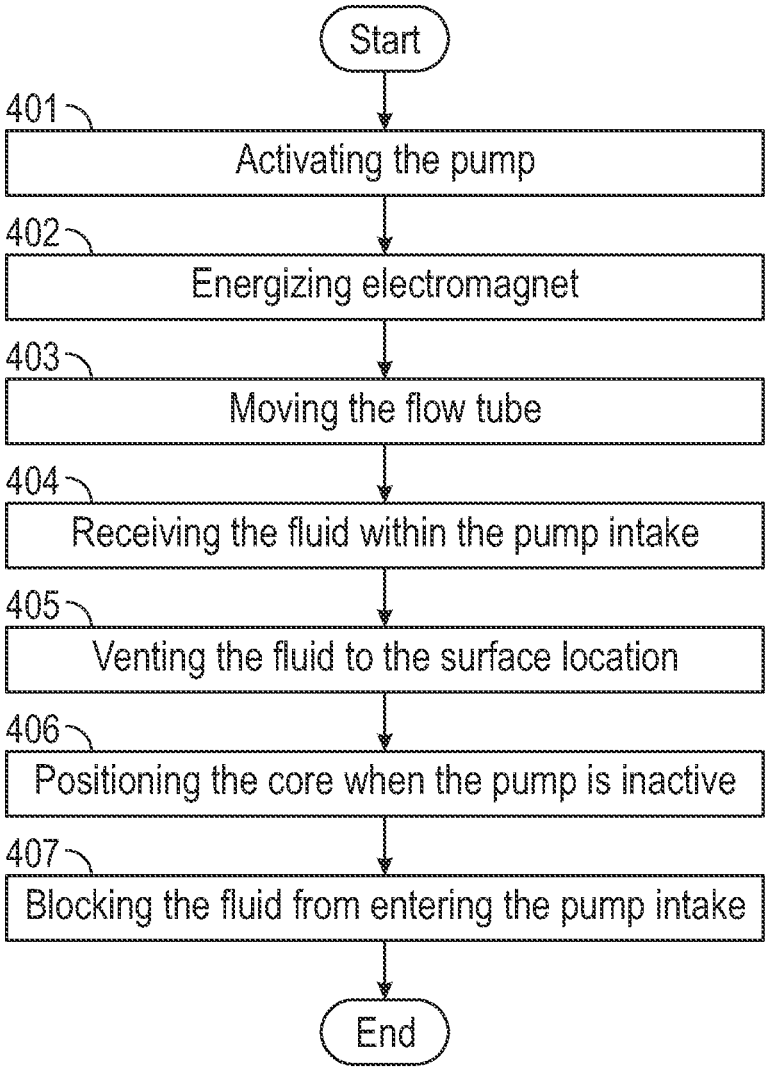
FIG. 4 shows a flowchart of a method in accordance with one or more embodiments of the present disclosure.

FIG. 4 depicts a flowchart of a method in accordance with one or more embodiments of the present disclosure. While the various flowchart blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 401, the pump (124) of the ESP (152) is activated. In some embodiments, subsequent to the activation of the pump (124), housing (178) is sealed by seal section (186) and input shaft (250) of generator (184) penetrates out through seal section (186). Output shaft (252) of the pump (124) may transfer, via shaft coupler (264), rotational mechanical energy to input shaft (250) of the generator (184) in the flow regulating valve (156). Generator (184) is configured to convert rotational mechanical energy to electrical power. Conductors (182) are connected between generator (184) electrical power output and electromagnet (162) input. Core (158) is disposed within electromagnet (162). Driver (232) of the magnetic coupler is attached to core (158). Driver (232) is configured to cooperate with driven coupler (234) attached to flow tube (146).

Prior to the pump (124) being activated, packer (190) may be set inside the production tubing (217). The ESP (152) may then be deployed into the well (116) using electrical cable (126) specially designed for use in the CDESP configuration. Accordingly, the ESP (152) stings into the packer (190), which isolates the pump discharge (154) from the pump intake (130), thereby preventing fluid recirculation within the system (150).

In block 402, Electrical power from surface location (114) produces rotation of output shaft (252) of pump (124). Output shaft (252) is attached to shaft coupler (264), thus shaft coupler (264) may rotate. Input shaft (250) of generator (184) receives rotational mechanical energy from output shaft (252) of pump (124) via shaft coupler (264). Generator (184) converts the rotational mechanical energy to electrical power. Conductors (182) transfer the electrical power output from generator (184) to electromagnet (162). Electrical power supplied to electromagnet (162) may induce an electromagnetic force in proximity to electromagnet (162). Electromagnet (162) induces a magnetic field to core (158) and produces an electromagnetic force in an uphole direction acting on core (158). The electromagnetic force acting on core (158) is opposed by spring (148), reacting against spring support (176), and acting on driver (232) attached to core (158).

In block 403, before, when, or after the uphole electromagnetic force acting on core (158) exceeds the downhole force produced by spring (148), then the core (158) moves uphole. If electromagnetic force acting on core (158) due to electrical power supplied to electromagnet (162) moves core (158) uphole, then spring (148) may compress, and if electromagnetic force acting on core (158) moves core (158) downhole, then spring (148) may expand. Consequently, as core (158) moves, the flow tube (146) attached to driven coupler (234) and magnetically coupled to driver (232) attached to core (158) also moves in the same direction.

In block 404, spring (148) of flow regulating valve (156) may be fully compressed. Accordingly, in some embodiments, when the spring (148) is fully compressed, the flow tube (146) may be positioned such that flow tube (146) does not cover intake slots (170) of the stinger (160). In this way, the flow tube (146) and the conduit (164) of the stinger (160) are in hydraulic communication. Here, a suction force created by the pump (124) may cause the fluid (102) disposed in the production tubing (117) to pass through the flow tube (146), into the conduit (164), and flow toward the pump intake (130).

In block 405, the fluid (102) may be pumped directly from the pump intake (130) through the pump (124) and into the pump discharge (154). Once at the pump discharge (154), the fluid (102) is vented into the production tubing (217) above the packer (190). Upon exiting the system (150), the fluid (102) travels upward in the well (116) towards the surface location (114) to be produced.

In block 406, after completion of the pumping operation, the pump (124) is turned off. When the pump (124) is no longer active, the suction force created by the pump (124) is diminished, and thus the fluid (102) is no longer drawn upwards within the system (150). In addition, when the pump (124) is inactive, the generator no longer generates electrical power, the electrical power no longer is provided to the electromagnet, and the core is no longer magnetically attracted to move uphole. Consequently, the spring force becomes greater than the electromagnetic force acting on the core (158), and thus the spring (148) may return the core (158) to its initial position.

In block 407, the spring (148) has repositioned the core (158) within the flow regulating valve (156) to a position such as where disk (174) contacts the stopper (392). Accordingly, when the spring (148) and core (158) come to rest, the core (158) and thus the flow tube (146) are positioned such that the exterior of the flow tube (146) is covering the intake slots (170) of the stinger (160). Consequently, fluid (102) disposed within the production tubing (217) is blocked from entering the system (150) as hydraulic communication between the pump intake (130) and production tubing (217) is lost. The system (150) may then be operated again or removed from the well (116).

Accordingly, the aforementioned embodiments as disclosed relate to systems (150) and methods useful for operating an SSSV (142). The disclosed systems and the methods of operating an SSSV (142) advantageously simplify operational deployment and retrieval challenges associated with CDESP systems. This benefit, in turn, advantageously reduces rig time and associated costs. In addition, the disclosed systems (150) for and methods of operating an SSSV (142) advantageously reduce sand accumulation within ESP systems (100).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system comprising:

an electric submersible pump assembly configured to transport a fluid in a casing string of a well to a surface location comprising:

a pump configured to receive, upon activation, the fluid through a pump intake and vent the fluid through a pump discharge;

an output shaft extending downhole from and fixed to the pump; and a control valve assembly comprising:

a movable core of an electromagnet movable along a central axis of the system;

a generator in electrical communication with the electromagnet, configured to generate electrical power to pull the movable core in an uphole direction upon activation of the pump of the electric submersible pump assembly;

a shaft coupler coupling a generator input shaft and the output shaft;

a stinger having a conduit for the fluid to flow from the tubing string to the pump intake, the stinger comprising:

at least one intake slot configured to receive the fluid; and an exit configured to vent the fluid to the pump intake of the electric submersible pump assembly;

a flow tube connected to the movable core, the flow tube comprising an exterior surface creating fluid communication between the flow tube and the stinger before, when, or after the exterior surface uncovers the at least one intake slot of the stinger; and a spring configured to slide the movable core upon deactivation of the pump of the electric submersible pump assembly.

2. The system according to claim 1, wherein the electric submersible pump assembly is a cable deployed electric submersible pump.

3. The system according to claim 1, wherein the control valve assembly is disposed downhole of the electric submersible pump assembly.

4. The system according to claim 1, wherein the stinger of the control valve assembly is attached to the pump of the electric submersible pump assembly.

5. The system according to claim 1, further comprising a packer configured to isolate the fluid entering the pump intake from the fluid exiting the pump discharge.

6. The system according to claim 1, wherein the control valve assembly further comprises a generator seal section configured to prevent sand accumulation within the system.

7. The system according to claim 1, wherein the spring of the control valve assembly is a compression spring.

8. The system according to claim 1, wherein the control valve assembly further comprises:

electrical conductors to provide electrical power from the generator to the electromagnet.

9. The system according to claim 8, wherein the control valve assembly further comprises a housing enclosing the generator, the movable core, the electromagnet, and the spring.

10. The system according to claim 9, wherein the control valve assembly further comprises a flow coupler comprising:

a driving magnetic coupler disposed within the housing; and a driven magnetic coupler disposed within the flow tube;

wherein the driving magnetic coupler and driven magnetic coupler are magnetically attracted to one another.

11. The system according to claim 9, wherein the housing contains a barrier fluid configured to provide lubrication to components disposed within the housing.

12. The system according to claim 9, wherein the housing is rigidly fixed to an interior of the stinger.

13. The system according to claim 9, wherein the flow tube is disposed downhole of a first end of the housing.

14. The system according to claim 13, wherein a second end of the housing is disposed within an interior of the flow tube.

15. A method for generating electrical power within a well by converting rotational mechanical energy into electrical power using an electromagnetic power generator system, the method comprising:

coupling, by a shaft coupler, a generator input shaft to an output shaft of a pump configured to transport a fluid;

coupling, by a flow coupler, a flow tube of a control valve assembly to a movable core of an electromagnet;

transferring, through the shaft coupler, rotational mechanical energy from the output shaft of the pump to the generator input shaft, thereby generating electromagnetic power;

conducting, through at least one electrical conductor, the electromagnetic power to the electromagnet, thereby thrusting the movable core in an uphole direction along a central axis;

uncovering at least one intake slot of a stinger before, when, or after an exterior surface of the flow tube moves in an uphole direction, thereby permitting fluid communication between the flow tube and the stinger;

receiving the fluid through the at least one intake slot of the stinger;

venting the fluid through an exit of the stinger to a pump intake of the pump;

venting, by a pump discharge of the pump, the fluid to a surface location subsequent to receiving the fluid through the pump intake; and sliding, by a spring, the movable core upon deactivation of the pump, thereby moving the exterior surface of the flow tube to cover at least one intake slot of the stinger.

16. The method of claim 15, further comprising setting a packer within a well between the stinger and a tubing string, thereby preventing fluid recirculation.

17. The method of claim 15, wherein thrusting the movable core in an uphole direction comprises compressing the spring.

18. The method of claim 15, wherein thrusting the movable core in an uphole direction comprises sliding the movable core within the electromagnet.

19. The method of claim 15, wherein thrusting the movable core in an uphole direction comprises pulling the flow tube in an uphole direction.

20. The method of claim 19, wherein pulling the flow tube in an uphole direction comprises magnetically attracting the flow tube to the movable core.

21. The method of claim 15, wherein receiving the fluid through the at least one intake slot of the stinger comprises transporting the fluid towards the exit of the stinger.

22. The method of claim 15, further comprising: deploying the pump via a power cable.

* * * * *